US006401737B1

(12) United States Patent
Kloor, III

(10) Patent No.: US 6,401,737 B1
(45) Date of Patent: Jun. 11, 2002

(54) UMBRELLA REPLACEMENT CANOPY

(75) Inventor: Frank Joseph Kloor, III, Palm Springs, CA (US)

(73) Assignee: Under Color LLC, Palm Springs, CA (US)

( * ) Notice: Subject to any disclaimer, the term of this patent is extended or adjusted under 35 U.S.C. 154(b) by 0 days.

(21) Appl. No.: 09/642,606

(22) Filed: Aug. 17, 2000

(51) Int. Cl.[7] ..... A45B 25/20

(52) U.S. Cl. ..... 135/33.7; 135/15.1; 135/31; 135/94; 135/98

(58) Field of Search ..... 135/98, 99, 15.1, 135/16, 19, 23, 33.2, 33.4, 33.7, 33.41, 33.6, 902, 908, 31, 94

(56) References Cited

U.S. PATENT DOCUMENTS

| | | | | | |
|---|---|---|---|---|---|
| 4,865,063 | A | * | 9/1989 | Williams | 135/35 V |
| 5,488,966 | A | | 2/1996 | Baldwin et al. | |
| 5,601,103 | A | * | 2/1997 | Dubinsky | 135/33.7 |
| 5,890,506 | A | * | 4/1999 | Kuperman | 135/33.2 |
| 6,170,499 | B1 | * | 1/2001 | Lin | 135/33.7 |
| 6,173,724 | B1 | * | 1/2001 | You | 135/33.7 |
| 6,237,616 | B1 | * | 5/2001 | You | 135/33.7 |

* cited by examiner

*Primary Examiner*—Carl D. Friedman
*Assistant Examiner*—Yvonne M. Horton
(74) *Attorney, Agent, or Firm*—Sawyer Law Group LLP

(57) ABSTRACT

The present invention provides an umbrella with a detachable canopy or vent top. The umbrella includes: a canopy, where the canopy may be detachably coupled to a frame; and a vent top, wherein the vent top may be detachably coupled to the canopy. In the preferred embodiment, the canopy may be comprised of eight, sixteen, or twenty-four panels. The vent top may be comprised of multiple panels as well. Each of the individual panels of the canopy may have a different color, so that canopies with various patterns are provided. The individual panels of the vent top may be provided in the same manner. In the preferred embodiment, both the canopy and the vent top also comprise a border, which may also be provided with a different color. Thus, by varying the color combinations of the panels of the canopy, the panels of the vent top, and the borders around the canopy and vent top, umbrellas with different patterns are possible. In this manner, the consumer need not purchase an entirely new umbrella to replace damaged or overly worn part(s) of the umbrella, or to have a different patterned canopy and/or vent top.

34 Claims, 11 Drawing Sheets

(4 of 11 Drawing Sheet(s) Filed in Color)

UMBRELLA REPLACEMENT CANOPY

FIELD OF THE INVENTION

The present invention relates to umbrellas, and more particularly to the canopy and vent tops of market umbrellas.

BACKGROUND OF THE INVENTION

Market umbrellas with canopies, such as those for patio furniture or pool side furniture, are well known in the art. FIG. 1A illustrates a conventional umbrella with a canopy and a vent top. The umbrella 100 comprises a frame 102 with eight spokes 104, evenly spaced apart and extending radially from a center pole 106. FIG. 1B illustrates in more detail the frame of the conventional umbrella. The diagram on the left illustrates the frame 102 when the umbrella is closed, and the diagram on the right illustrates the frame 102 when the umbrella is open. The inner end of each spoke 104 is attached to the top of the center pole 106, either directly or via a ring 116 which is attached to the center pole 106. The spokes 104 are raised when the umbrella 100 is opened. Some frames also comprise holes 120 on the pole 106. A pin (not shown) inserts themselves into one of the holes 120 to hold the umbrella is an open position. Multiple holes 120 may be provided to allow for different degrees of openness. Alternatively, the frame may use a crank method to open the umbrella, as is well known in the art. The frame 102 also comprises a knob 118 which attach to the top of the center pole 106. The knob 118 also assist in holding the vent top 110 (FIG. 1A) in place.

Returning to FIG. 1A, laying on top of the frame 102 and attached to the outer ends of the spokes 104 is a canopy 108, usually composed of a material such as canvas. The canopy 108 is typically composed of wedge-shaped panels 112 of material, sewn together. Most conventional umbrellas have eight panels, with the canopy 108 forming an octagonal shape when laid flat. The canopy 108 is attached to the outer end of each spoke 104 at the seams between the panels 112.

At the top of the frame 102, and attached to the canopy 108, is a vent top 110. The vent top 110 is attached to the canopy intermittently at certain locations, typically at the seams between the panels 112, so that openings 114 are provided between the canopy 108 and the vent top 110. The vent top 110 is also typically composed of wedge-shaped panels (not shown), with the vent top 110 forming an octagonal shape when laid flat. With this shape, each vertex of the vent top's octagon is attached to a seam between the panels 112. The knob 118 helps to hold the vent top 110 in place on the frame 102.

However, the canopy 108 of the conventional umbrella 100 is fixedly attached to the frame 102, and the vent top 110 is fixedly attached to the canopy 108. Thus, when the frame 102, the canopy 108, and/or the vent top 110 become damaged or overly worn, an entirely new umbrella must be purchased, even though the other parts of the umbrella 100 are still functional. Also, if the consumer wishes to have an umbrella with a canopy and/or vent top of a different color, an entirely new umbrella must be purchased. This is costly to the consumer.

Accordingly, there exists a need for an umbrella with a detachable canopy or vent top. The present invention addresses such a need.

SUMMARY OF THE INVENTION

The present invention provides an umbrella with a detachable canopy or vent top. The umbrella includes: a canopy, where the canopy may be detachably coupled to a frame; and a vent top, wherein the vent top may be detachably coupled to the canopy. In the preferred embodiment, the canopy may be comprised of eight, sixteen, or twenty-four panels. The vent top may be comprised of multiple panels as well. Each of the individual panels of the canopy may have a different color, so that canopies with various patterns are provided. The individual panels of the vent top may be provided in the same manner. In the preferred embodiment, both the canopy and the vent top also comprise a border, which may also be provided with a different color. Thus, by varying the color combinations of the panels of the canopy, the panels of the vent top, and the borders around the canopy and vent top, umbrellas with different patterns are possible. In this manner, the consumer need not purchase an entirely new umbrella to replace damaged or overly worn part(s) of the umbrella, or to have a different patterned canopy and/or vent top.

BRIEF DESCRIPTION OF THE FIGURES

The file of this patent contains at least one drawing executed in color. Copies of this patent with color drawing (s) will be provided by the Patent and Trademark Office upon request and payment of necessary fee.

DETAILED DESCRIPTION

The present invention provides an umbrella with a detachable canopy or vent top. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

The umbrella in accordance with the present invention comprises a canopy which is detachable from the frame and a vent top which is detachable from the canopy. In the preferred embodiment, the canopy may be comprised of eight, sixteen, or twenty-four panels. The vent top may be comprised of multiple panels as well. Each of the individual panels of the canopy may have a different color, so that canopies with various patterns are provided. The individual panels of the vent top may be provided in the same manner. In the preferred embodiment, both the canopy and the vent top also comprise a border, which may also be provided with a different color. Thus, by varying the color combinations of the panels of the canopy, the panels of the vent top, and the borders around the canopy and vent top, umbrellas with different patterns are possible. In this manner, the consumer need not purchase an entirely new umbrella to replace damaged or overly worn part(s) of the umbrella, or to have a different patterned canopy and/or vent top.

To more particularly describe the features of the present invention, please refer to FIGS. 2 through 10 in conjunction with the discussion below.

Figure 1A:
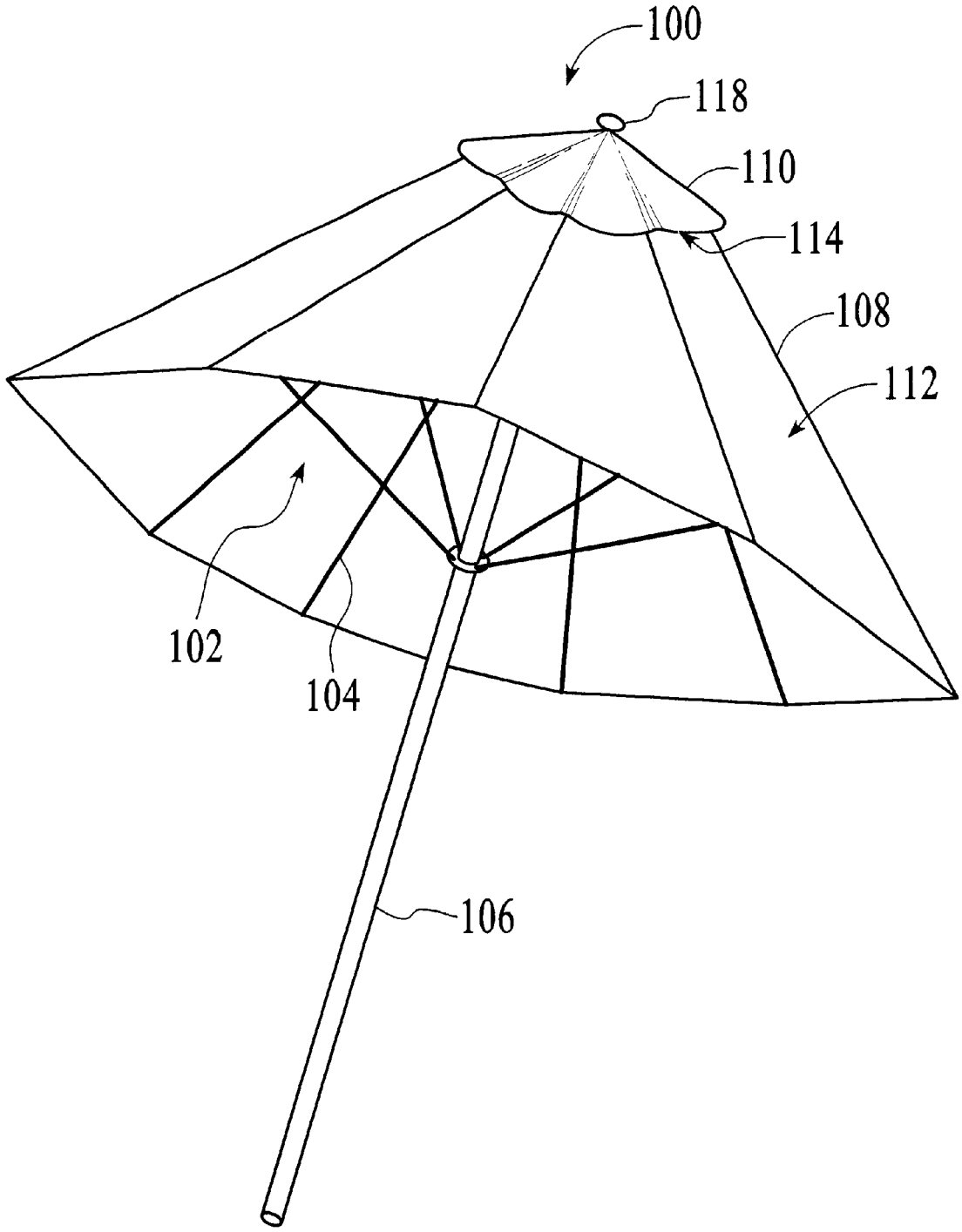
FIG. 1A (PRIOR ART)
FIG. 1A illustrates a conventional umbrella with a canopy and a vent top.
Figure 1B:
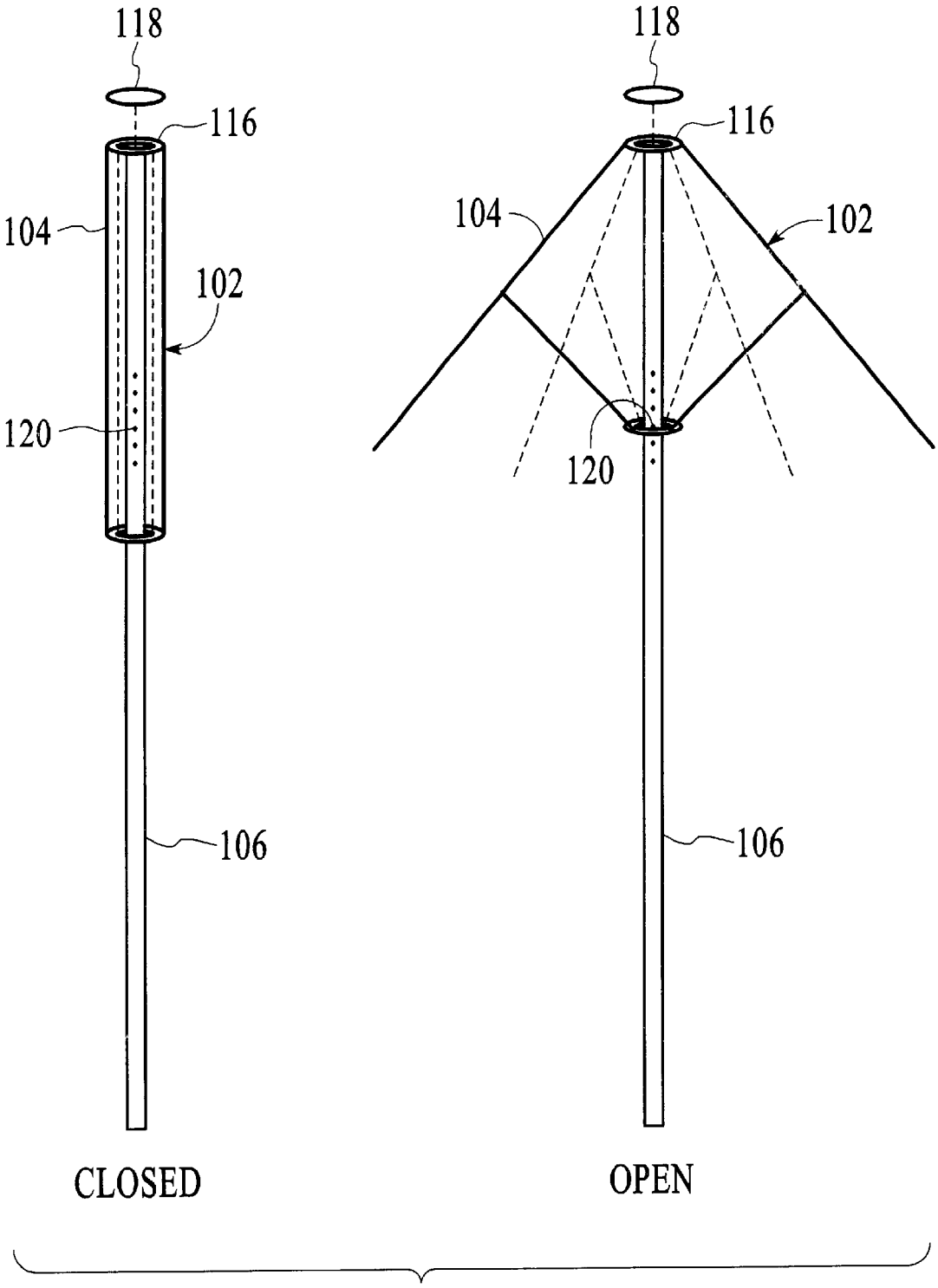
FIG. 1B (PRIOR ART)
FIG. 1B illustrates in more detail the frame of the conventional umbrella.
Figure 2:
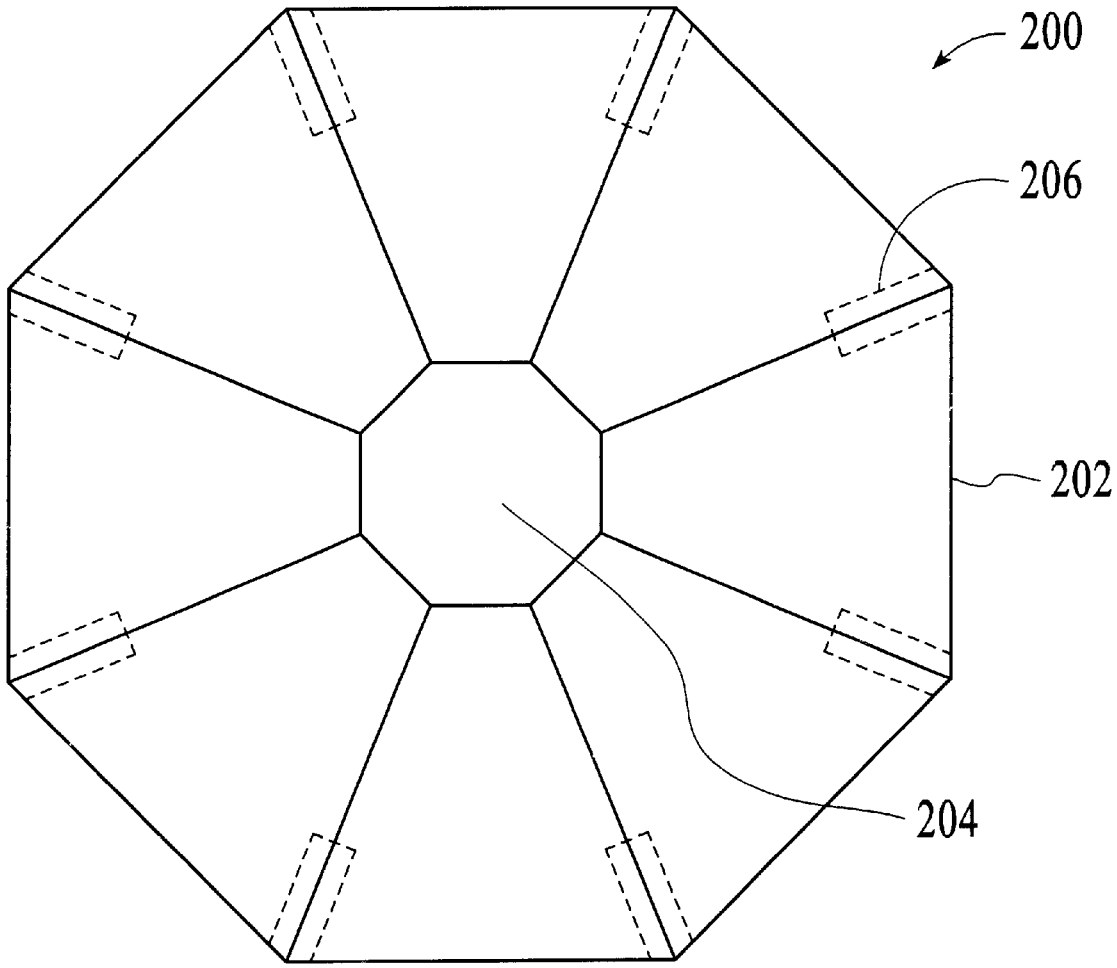
FIG. 2 illustrates a first preferred embodiment of a detachable canopy in accordance with the present invention.

FIG. 2 illustrates a first preferred embodiment of a detachable canopy in accordance with the present invention. The canopy 200 is composed of a material, such as acrylic canvas, etc. It comprises eight wedge-shaped panels 202 sewn together such that the canopy 200 forms an octagonal shape when laid flat. With the panels 202 sewn together, an opening 204 remains in the center of the canopy 200. At each seam between the panels 202 and near each vertex of the octagon, a pocket 206 is provided into which an outer end of a spoke 104 of the frame 102 (FIG. 1) would reside. The top of the frame 102 would protrude through the opening 204. When the umbrella with the canopy 200 is fully opened, the spokes 104 move within the pockets 206 such that the spokes 104 abut against the outer end of the pockets 206, pushing the canopy 200 tightly across the frame 102.

With the pockets 206, the canopy 200 is not fixedly attached to the frame 102. Thus, the canopy 200 may be easily detached from the frame by removing the spokes 104 of the frame 102 from the pockets 206.

Figure 3:
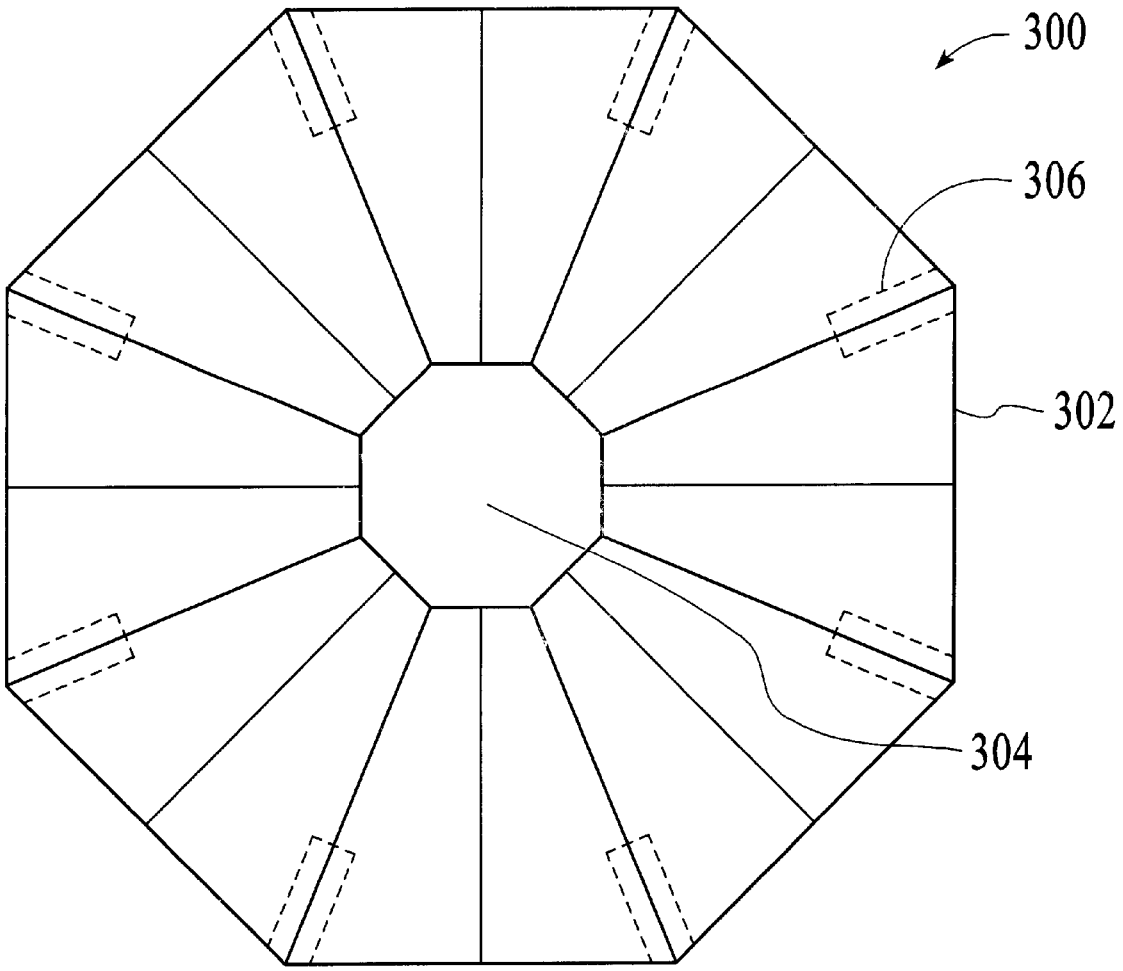
FIG. 3 illustrates a second preferred embodiment of a detachable canopy in accordance with the present invention.

FIG. 3 illustrates a second preferred embodiment of a detachable canopy in accordance with the present invention. The canopy 300 is similar to the canopy 200 except the canopy 300 comprises sixteen wedge-shaped panels 302 sewn together. As with the canopy 200, the canopy 300 forms an octagonal shape when laid flat on the ground. The panels 302 may be formed by dividing each panel 202 of canopy 200 into two panels. An opening 304 remains in the center of the canopy 300 through which the top of the frame 102 would protrude. Pockets 306 are provided at the seams between the panels 302 at each vertex of the octagon. The outer end of a spoke 104 of the frame 102 would reside in each pocket 306. The pockets 306 function in the same manner as with the pockets 206 of the canopy 200.

Figure 4:
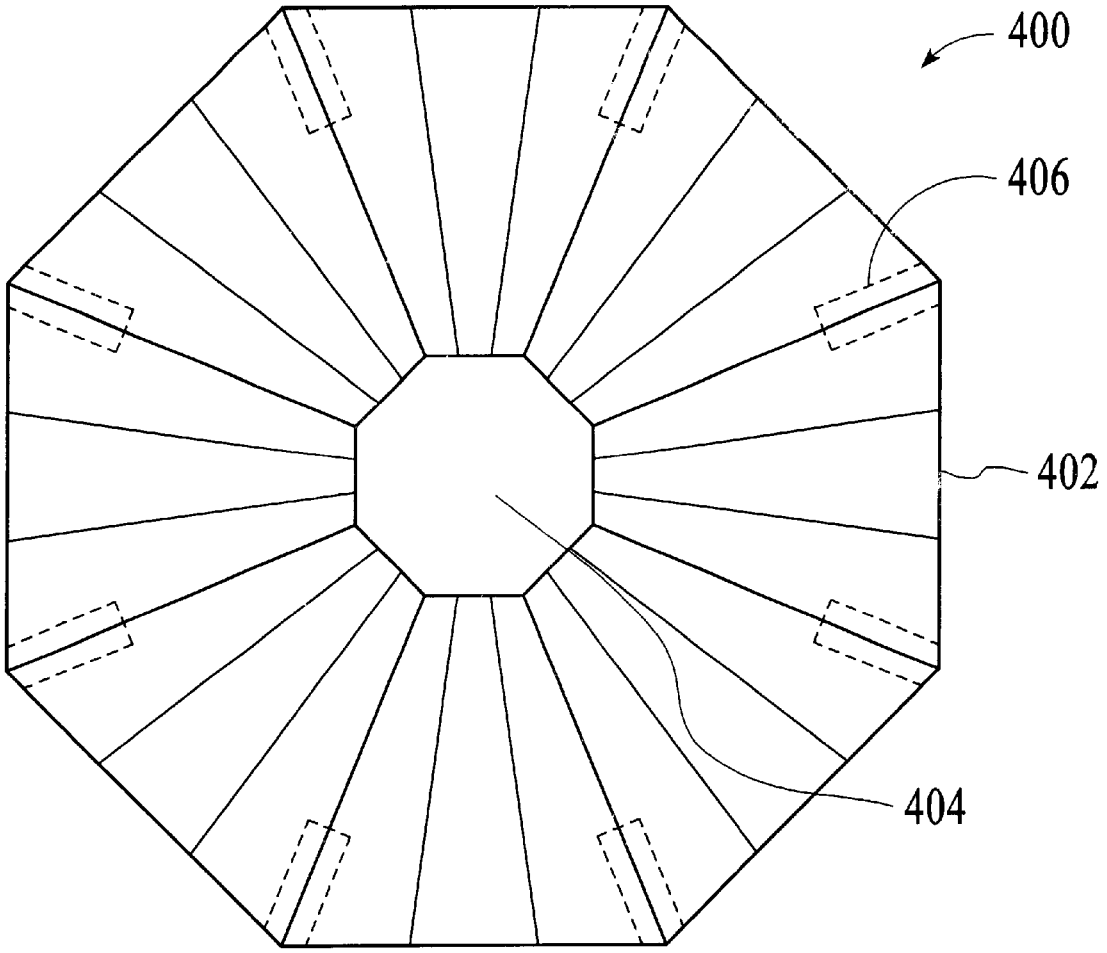
FIG. 4 illustrates a third preferred embodiment of a detachable canopy in accordance with the present invention.

FIG. 4 illustrates a third preferred embodiment of a detachable canopy in accordance with the present invention. The canopy 400 is similar to the canopy 200 except the canopy 400 comprises twenty-four wedge-shaped panels 402 sewn together. As with the canopy 200, the canopy 400 forms an octagonal shape when laid flat on the ground. The panels 402 may be formed by dividing each panel 202 of canopy 200 into three panels. An opening 404 remains in the center of the canopy 400 through which the top of the frame 102 would protrude. Pockets 406 are provided at seams between panels at each vertex of the octagon. The outer end of a spoke 104 of the frame 102 would reside in each pocket 406. The pockets 406 function in the same manner as with the pockets 206 of the canopy 200. With the pockets 306, 406, the canopies 300, 400 are not fixedly attached to the frame 102. Thus, the canopies 300,400 may be easily detached from the frame by removing the spokes 104 of the frame 102 from the pockets 306, 406.

Figure 5:
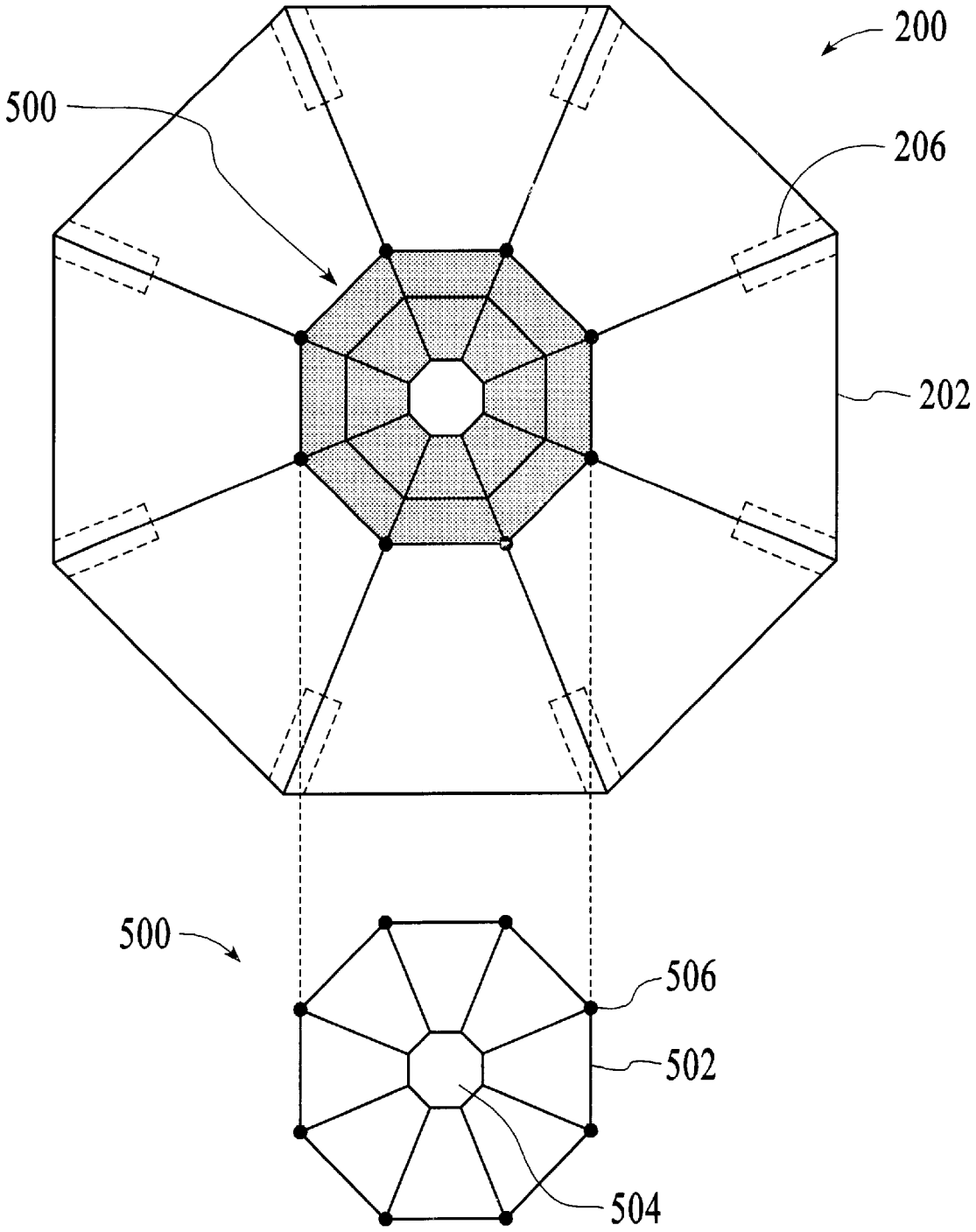
FIG. 5 illustrates a preferred embodiment of a detachable canopy and a detachable vent top in accordance with the present invention.

FIG. 5 illustrates a preferred embodiment of a detachable canopy and a detachable vent top in accordance with the present invention. The vent top 500 is composed of a material, such as canvas. In the preferred embodiment, the vent top 500 comprises eight wedge-shaped panels 502 sewn together such that the vent top 500 forms an octagonal shape when laid flat on the ground. The panels 502 may also be changed to form sixteen wedge-shaped panels in the same manner as with the panels 302 of canopy 300. With the panels 502 sewn together, an opening 504 remains in the center of the vent top 500. The top of the frame 102 would protrude through the opening 504. At each seam between the panels 502 and near each vertex of the octagon, an attachment mechanism 506, such as a snap, is provided which is capable of attaching the vent top 500 to the canopy 200. In the preferred embodiment, the snaps 506 attach to the canopy 200 at the seams between each panel 202. Thus, the vent top 500 may be attached to the canopy 200 at the snaps 506 while openings remain between the snaps 506. The vent top 500 would attach to the canopies 300 and 400 in the same manner. Thus, the vent top 500 may be easily detached from the canopy 200 by disengaging the snaps 506. In this manner, the consumer need not purchase an entirely new umbrella to replace a damaged or overly worn canopy and/or vent top.

When the umbrella with the canopy 200 and the vent top 500 is fully opened, the spokes 104 push at the canopy 200 as explained above, while the top of the frame 102 pushes against the vent top 500 at the opening 504. This results in the canopy 200 and the vent top 500 being pulled tightly across the frame 102.

Figure 6:
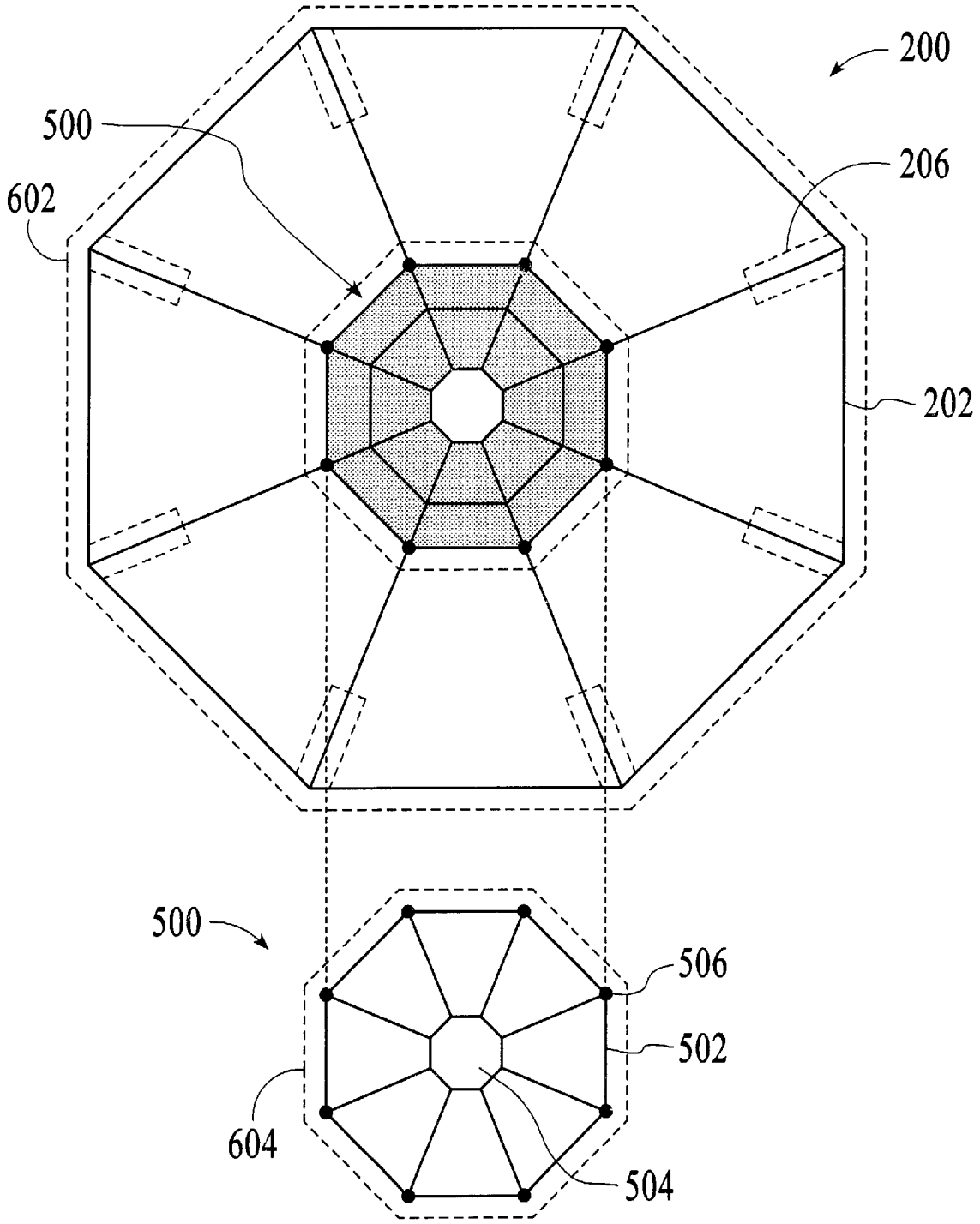
FIG. 6 illustrates a preferred embodiment of a detachable canopy and a detachable vent top with borders in accordance with the present invention.

FIG. 6 illustrates a preferred embodiment of a detachable canopy and a detachable vent top with borders in accordance with the present invention. In addition to the above, the canopy 200 may also comprise a border 602 around the outer edges of the octagon. The canopies 300 and 400 may also comprise the border 602. Similarly, in addition to the above, the vent top 500 may also comprise a border 604 around the outer edges of its octagon. These borders provide the canopy 200 and the vent top 500 with a more finished appearance and take part in the pattern of the umbrella, as described below. The borders 602, 604 also assist in securing the pockets 206 to the canopy 200.

The different panels 202, 302, 402 of the canopies 200, 300, 400 may have different colors. The different panels 502 of the vent top 500 and the borders 602, 604 may also have different colors. FIGS. 7–10 and the discussion below illustrate more particularly this feature of the present invention.

Figure 7:
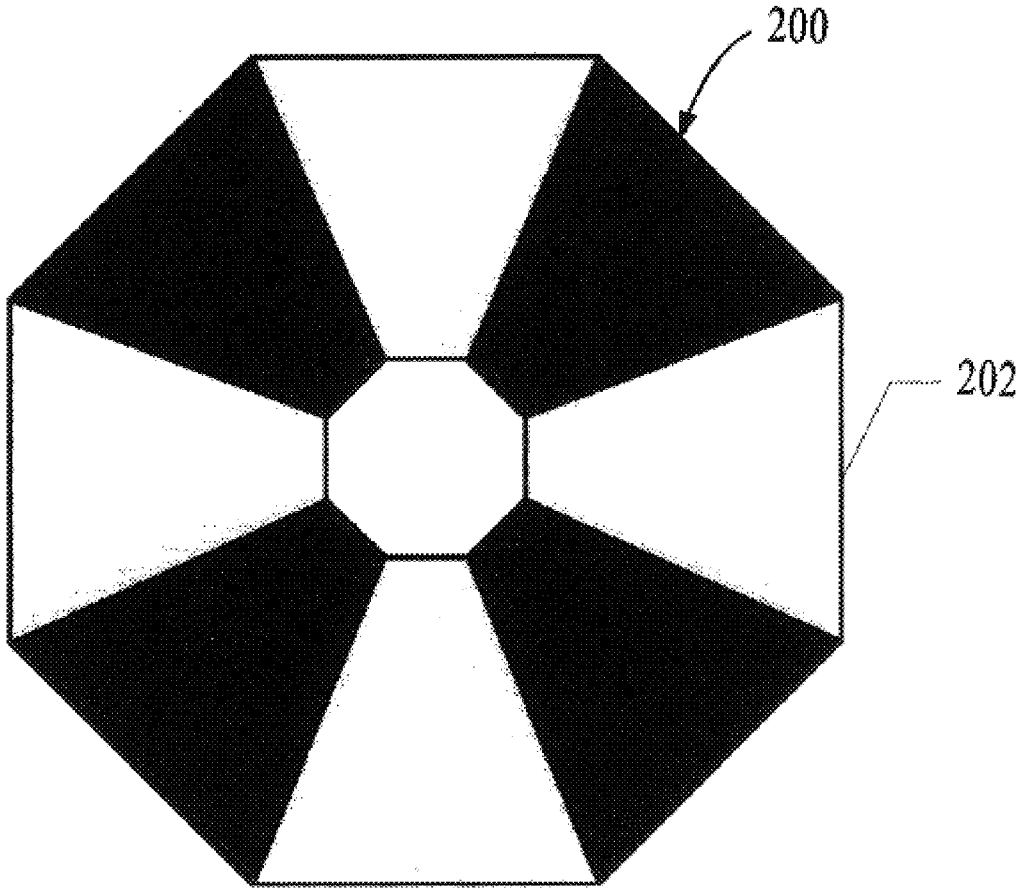
FIG. 7 illustrates the first preferred embodiment of the canopy with colors in accordance with the present invention.

FIG. 7 illustrates the first preferred embodiment of the canopy 200 with colors in accordance with the present invention. Each of the eight panels 202 of the canopy 200 have a color. In this example, each panel 202 is either blue or yellow, with the colors alternating, resulting in the pattern as illustrated.

Figure 8:
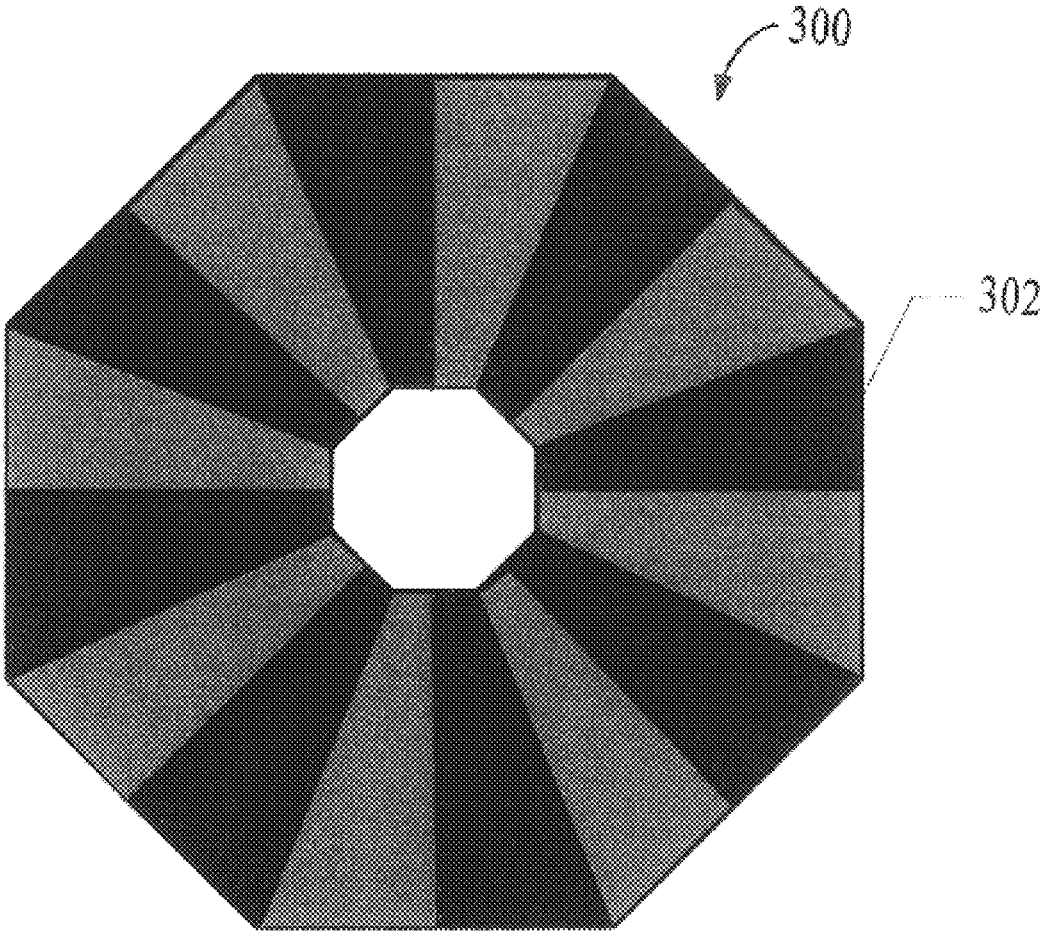
FIG. 8 illustrates the second preferred embodiment of the canopy with colors in accordance with the present invention.

FIG. 8 illustrates the second preferred embodiment of the canopy 300 with colors in accordance with the present invention. Each of the sixteen panels 302 of the canopy 300 have a color. In this example, each panel 302 is either blue or pink, with the colors alternating, resulting in the pattern as illustrated.

Figure 9:
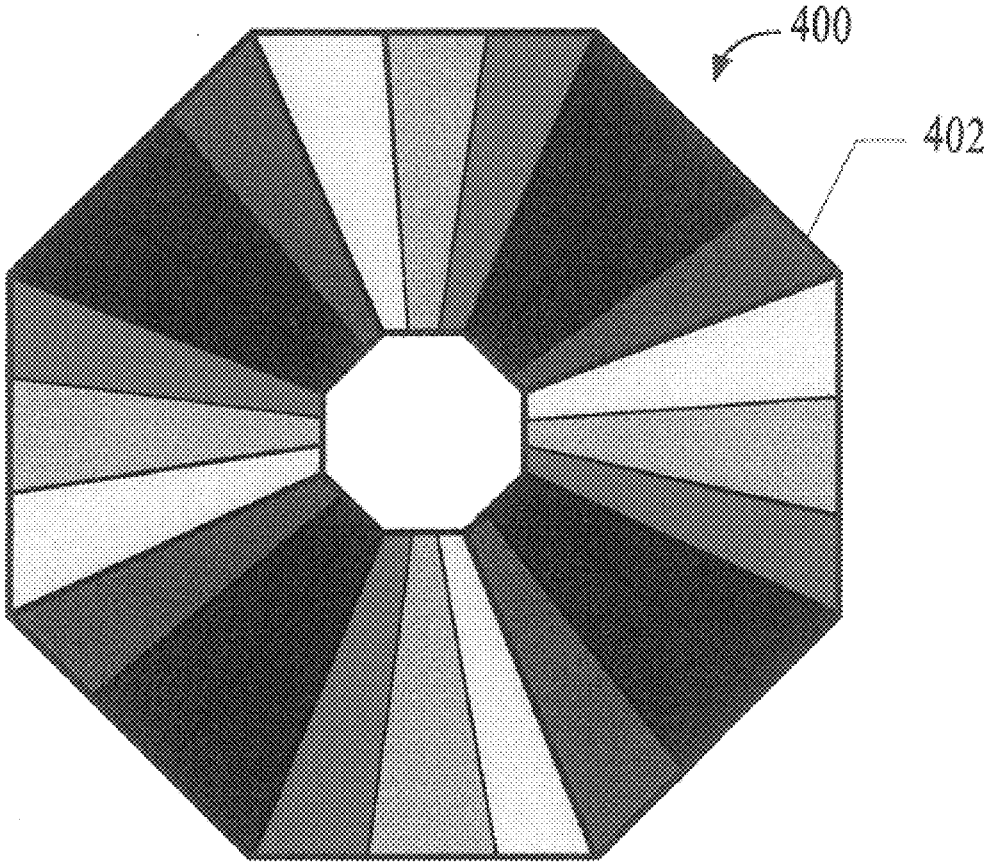
FIG. 9 illustrates the third preferred embodiment of the canopy with colors in accordance with the present invention.

FIG. 9 illustrates the third preferred embodiment of the canopy 300 with colors in accordance with the present invention. Each of the twenty-four panels 402 of the canopy 400 have a color. In this example, the panels 402 are in a repeating color series comprising yellow, orange, red, purple, blue, and green, resulting in the pattern as illustrated.

Figure 10:
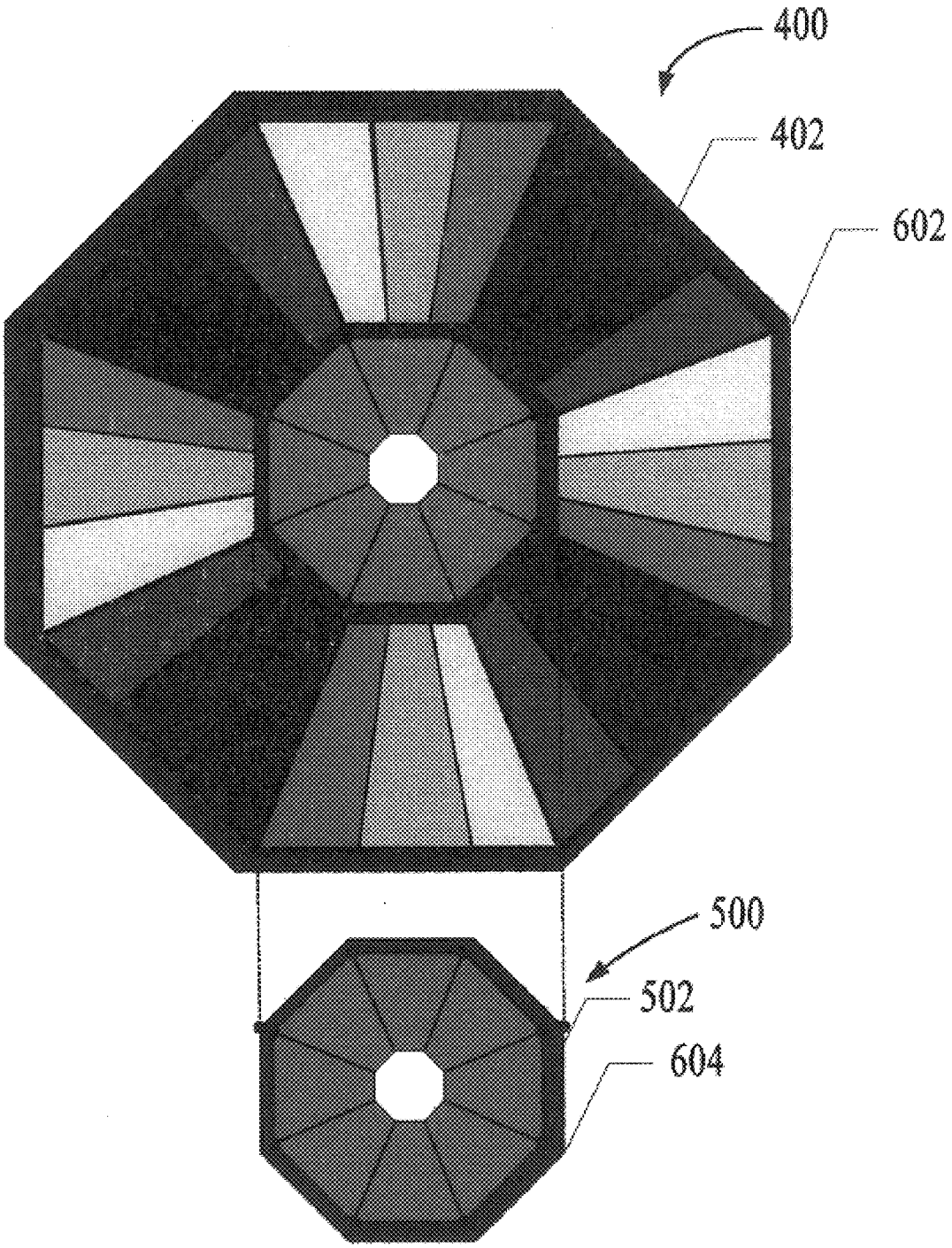
FIG. 10 illustrates the preferred embodiment of the vent top and the borders with colors in accordance with the present invention.

FIG. 10 illustrates the preferred embodiment of the vent top 500 and the borders 602, 604 with colors in accordance with the present invention. In addition to the color illustrated with canopies 200, 300, and 400 above, the vent top 500 and the borders 602, 604 may also have colors. For example, the canopy 400 may have a vent top 500 whose panels 502 are red. The borders 602 and 604 are blue. Thus, the panels 502 of the vent top 500 and the borders 602, 604 become part of the pattern of the umbrella. Each of the panels 502 of the vent top 500 may also be of a different color, in a similar manner as the panels 302, 402, and 502 illustrated in FIGS. 7–9.

Thus, by varying the color combinations of the panels 202, 302, 402 of the canopies 200, 300, 400, the panels 502 of the vent top 500, and the borders 602, 604, umbrellas with different patterns are possible. Although the preferred embodiments have been disclosed with the color patterns above, one of ordinary skill in the art will understand that other color combinations may be used without departing from the spirit and scope of the present invention.

Although the canopies and vent tops have been disclosed with the number of panels as described above, one of ordinary skill in the art will understand that any number of panels may be provided, such as 4 or 6 panels, without departing from the spirit and scope of the present invention.

An umbrella with a detachable canopy or vent top is disclosed. The umbrella in accordance with the present invention comprises a canopy which is detachable from the frame and a vent top which is detachable from the canopy. In the preferred embodiment, the canopy may be comprised of eight, sixteen, or twenty-four panels. The vent top may be comprised of multiple panels as well. Each of the individual panels of the canopy may have a different color, so that canopies with various patterns are provided. The individual panels of the vent top may be provided in the same manner. In the preferred embodiment, both the canopy and the vent top also comprise a border, which may also be provided with a different color. Thus, by varying the color combinations of the panels of the canopy, the panels of the vent top, and the borders around the canopy and vent top, umbrellas with different patterns are possible. In this manner, the consumer need not purchase an entirely new umbrella to replace damaged or overly worn part(s) of the umbrella, or to have a different patterned canopy and/or vent top.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. An umbrella, comprising:

a canopy, wherein the canopy is detachably coupled to a frame; and a vent top, wherein the vent top is detachably coupled to the canopy, wherein at a location where the vent top is detachably coupled to the canopy, the vent top is not coupled to the frame.

2. The umbrella of claim 1, wherein the canopy comprises a plurality of panels, wherein the plurality of panels are coupled together to form an octagon.

3. The umbrella of claim 2, wherein the canopy comprises eight panels.

4. The umbrella of claim 2, wherein the canopy comprises sixteen panels.

5. The umbrella of claim 2, wherein the canopy comprises twenty-four panels.

6. The umbrella of claim 2, further comprising a plurality of pockets coupled to the plurality of panels at each vertex of the octagon.

7. The umbrella of claim 6, wherein the canopy further comprises a border.

8. The umbrella of claim 7, wherein the border is coupled to the plurality of pockets and the plurality of panels.

9. The umbrella of claim 7, wherein the border comprises a color.

10. The umbrella of claim 2, wherein the plurality of panels comprises at least one color.

11. The umbrella of claim 10, wherein the plurality of panels comprises two alternating colors.

12. The umbrella of claim 10, wherein the plurality of panels comprises a repeating series of colors.

13. The umbrella of claim 1, wherein the vent top comprises a plurality of panels, wherein the plurality of panels are coupled together to form an octagon.

14. The umbrella of claim 13, wherein the plurality of panels comprises at least one color.

15. The umbrella of claim 14, wherein the plurality of panels comprises two alternating colors.

16. The umbrella of claim 14, wherein the plurality of panels comprises a repeating series of colors.

17. The umbrella of claim 13, wherein the vent top further comprises a plurality of attachment mechanisms, wherein the attachment mechanisms are capable of detachably coupling the vent top to the canopy, wherein at a location where the vent top is detachably coupled to the canopy, the attachment mechanisms do not couple the vent top to the frame.

18. The umbrella of claim 17, wherein the plurality of attachment mechanisms comprises a plurality of snaps.

19. The umbrella of claim 13, wherein the vent top further comprises a border.

20. The umbrella of claim 19, wherein the border comprises a color.

21. A vent top for an umbrella, comprising:

a plurality of panels, wherein the plurality of panels are coupled together to form an octagon; and a plurality of attachment mechanisms, wherein the attachment mechanisms are capable of detachably coupling the vent top to a canopy, wherein at a location where the vent top is detachably coupled to the canopy, the attachment mechanisms do not couple the vent top to a frame.

22. The vent top of claim 21, wherein the plurality of panels comprises at least one color.

23. The vent top of claim 22, wherein the plurality of panels comprises two alternating colors.

24. The vent top of claim 22, wherein the plurality of panels comprises a repeating series of colors.

25. The vent top of claim 22, wherein the plurality of attachment mechanisms comprises a plurality of snaps.

26. The vent top of claim 21, further comprising a border.

27. The vent top of claim 26, wherein the border comprises a color.

28. A method for providing an umbrella, comprising the steps of:

(a) providing a canopy, wherein the canopy is detachably coupled to a frame; and (b) providing a vent top, wherein the vent top is detachably coupled to the canopy, wherein at a location where the vent top is detachably coupled to the canopy, the vent top is not coupled to the frame.

29. A method for providing a vent top for an umbrella, comprising the steps of:

(a) providing a plurality of panels, wherein the plurality of panels are coupled together to form an octagon; and (b) providing a plurality of attachment mechanisms, wherein the attachment mechanisms are capable of detachably coupling the vent top to a canopy, wherein at a location where the vent top is detachably coupled to the canopy, the attachment mechanisms do not couple the vent top to a frame.

30. An umbrella, comprising:

a canopy, wherein the canopy comprises a first plurality of panels, wherein the first plurality of panels comprises at least one color, wherein the canopy is detachably coupled to a frame; and a vent top, wherein the vent top comprises a second plurality of panels, wherein the second plurality of panels comprises at least one color, wherein the vent top is detachably coupled to the canopy, wherein at a location where the vent top is detachably coupled to the canopy, the vent top is not coupled to the frame.

31. The umbrella of claim 30, wherein the first plurality of panels comprises twenty-four panels.

32. The umbrella of claim 31, wherein the twenty-four panels comprises a repeating color series.

33. The umbrella of claim 32, wherein the repeating color series comprises yellow, orange, red, purple, blue, and green.

34. A vent top for an umbrella, comprising:

a plurality of panels, wherein the plurality of panels comprises at least one color, wherein the plurality of panels are coupled together to form an octagon; and a plurality of attachment mechanisms coupled to the plurality of panels for detachably coupling the vent top to a canopy, wherein at a location where the vent top is detachably coupled to the canopy, the plurality of attachment mechanisms do not couple the vent top to a frame.

* * * * *